United States Patent [19]

Ebihara

[11] Patent Number: 4,828,243

[45] Date of Patent: May 9, 1989

[54] ACCUMULATED BILLS DELIVERING APPARATUS FOR BILL RECEIVING AND DISPENSING MACHINE

[75] Inventor: Hideyuki Ebihara, Hachioji, Japan

[73] Assignee: Laurel Bank Machines Co., Ltd., Tokyo, Japan

[21] Appl. No.: 110,363

[22] Filed: Oct. 20, 1987

[30] Foreign Application Priority Data

Oct. 28, 1986 [JP] Japan ..... 61-256377

[51] Int. Cl.[4] ..... B65H 29/54; B65H 29/40

[52] U.S. Cl. ..... 271/3.1; 271/187; 271/308; 271/315; 194/206; 209/534; 235/379

[58] Field of Search ..... 194/206, 207; 271/3.1, 271/3, 306, 307, 308, 178, 187, 213, 214, 314, 315; 209/534; 235/379, 380, 381; 414/43, 46, 48, 49

[56] References Cited

U.S. PATENT DOCUMENTS

| | | | |
|---|---|---|---|
| 2,109,050 | 2/1938 | Quick et al. | 271/315 X |
| 4,102,253 | 7/1978 | Gannicott | 271/315 X |
| 4,431,178 | 2/1984 | Kokubo et al. | 271/187 |
| 4,439,083 | 3/1984 | Jenkins et al. | 414/48 X |

FOREIGN PATENT DOCUMENTS

| | | |
|---|---|---|
| 3431779 | 8/1984 | Fed. Rep. of Germany . |
| 3519635 | 5/1985 | Fed. Rep. of Germany . |
| 58-39392 | 3/1983 | Japan . |
| 60-59492 | 4/1985 | Japan . |
| 60-67334 | 4/1985 | Japan . |
| 60-78332 | 5/1985 | Japan . |
| 60-100283 | 6/1985 | Japan . |
| 60-251487 | 12/1985 | Japan . |
| 61-18087 | 1/1986 | Japan . |

*Primary Examiner*—Joseph J. Rolla
*Assistant Examiner*—Edward S. Ammeen
*Attorney, Agent, or Firm*—Fleit, Jacobson, Cohn & Price

[57] ABSTRACT

A bill delivering apparatus for delivering accumulated bills to a horizontally spaced-apart position within a bill receiving and dispensing machine wherein the accumulated bills are automatically dropped into the bill delivering position by a scraping member when a supporting plate bearing the accumulated bills thereon is horizontally retracted. This makes it possible to reliably and easily deliver the bills while keeping them in accumulated condition only by dropping them into the bill receiving and dispensing mouth without need for the complicated clamping mechanism of the prior art for pressing the top and bottom surfaces of the accumulated bills. In the bill delivering apparatus, the supporting plate is automatically retracted by the engaging member and the bills accumulated on the supporting plate are delivered to a transaction port when the accumulated bills are horizontally moved by the movement of the slide rails. This makes it possible to continuously carry out both the transferring and delivering operations of the accumulated bills by a single power source. Also, according to the bill delivering apparatus of the present invention, the supporting plate is held in inclined condition by the upwardly inclined portion of the slide rails just under an accumulation wheel and can immediately receive thereon the bills from the accumulation wheel so that the ends of bills positionally abut against the scraping member. This makes it possible to stabilize the accumulated condition of the bills.

2 Claims, 6 Drawing Sheets

ACCUMULATED BILLS DELIVERING APPARATUS FOR BILL RECEIVING AND DISPENSING MACHINE

BACKGROUND OF THE INVENTION

The present invention relates to a bill delivering apparatus used in a bill receiving and dispensing machine and more particularly to a bill delivering apparatus for delivering accumulated bills to a horizontally spaced-apart position within a bill receiving and dispensing machine.

Heretofore, a bill delivering apparatus has been used in a bill receiving and dispensing machine for delivering accumulated bills to a horizontally spaced-apart position, for example, as disclosed in Japanese laid-open patent publication No. 251487/1985. This apparatus is so constructed that it transfers bills by sandwiching them between carrying belts toward a bill receiving and dispensing mouth mechanism horizontally spaced apart from a bill accumulating portion after accumulation of bills at the bill accumulating portion and that it receives bills fed out from the carrying belts by clamping rollers of the bill receiving and dispensing mouth mechanism.

However, the bill delivering apparatus of the prior art is required to have carrying belts and clamping rollers on both the feeding-out side and the receiving side in order to dispense the bills without crumpling of the accumulated bills and is also required to combine the carrying belts and the clamping rollers with bill pressing function. In addition, it has to be provided with a control means to keep the pressing function of the clamping rollers idle during bill delivering operation and to clamp the bills after reception of bills and is also required to be provided with separate power sources for the respective means. This makes the apparatus complicated and large in size.

SUMMARY OF THE INVENTION

It is an object of the present invention to provide a simple and compact bill delivering apparatus which can solve the problems above mentioned and reliably carry out the bill delivering operation.

According to the present invention, there is provided a bill delivering apparatus for delivering accumulated bills to a horizontally spaced-apart position within a bill receiving and dispensing machine comprising: a scraping member for scraping off the bills fed one by one to an accumulation wheel with the scraping member contacting the ends of bills and being adapted to be horizontally driven by a driving mechanism; a supporting plate for supporting the scraped-off bills thereon in accumulated condition adapted to be horizontally movable relative to the scraping member; slide rails horizontally secured to the back of the scraping member and adapted to be engageable with the end of the supporting member so as to move it longitudinally; a spring for urging the supporting plate in a direction reverse to the movement of the slide rails during the delivery of bills; a pushing-out member mounted for vertical rotation on the back of the scraping member and adapted to move the scraping member together with the supporting member with the pushing-out member supporting the end of the supporting plate; a stopper secured to a machine body for limiting the movement of the supporting plate in the urging direction of the spring with the stopper abutted against the supporting plate at the accumulating position of bills; and an engaging member secured to the machine body and adapted to rotate the pushing-out member with the engaging member abutted against the pushing-out member at the bill delivering position and to release the engagement of the pushing-out member with the supporting plate.

In the bill delivering apparatus of the present invention, the supporting plate is pushed out by the pushing-out member and horizontally moved together with the slide rails with the slide rails moved horizontally after having accumulated the bills on the supporting plate. Then, when the supporting plate arrives at the bill delivering position, the pushing-out member is rotated by the engaging member and therefore the support for the supporting plate by the pushing-out member ceases. Thus, the supporting plate is returned by the urging force of the spring along the slide rails until it abuts against the stopper and the accumulated bills abutting against the scraping member on the supporting plate are dropped onto the bill delivering position.

BRIEF DESCRIPTION OF THE DRAWINGS

Other objects and advantages of the present invention will become apparent from the following detailed description of a preferred embodiment of the present invention taken in reference to the accompanying drawings in which.

Figure 1:
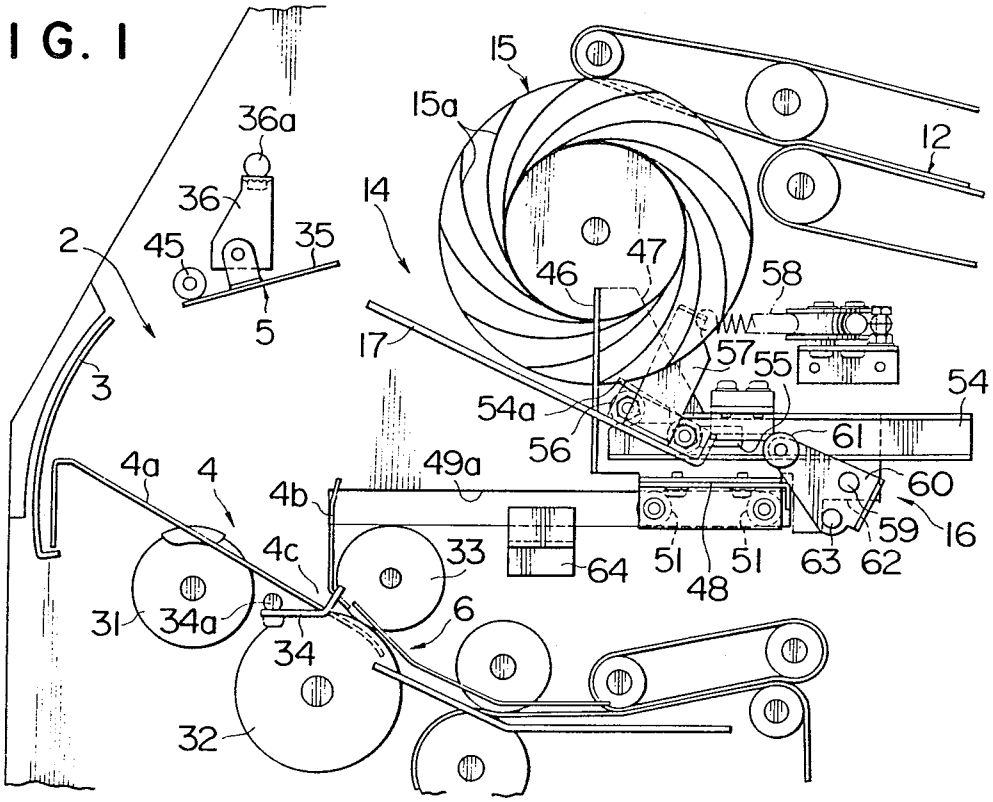
FIG. 1 is a cross-sectional side elevational view showing the bill delivering apparatus and the transaction port means.

This embodiment relates to a case wherein the bill delivering apparatus of the present invention is applied to a bill receiving and dispensing machine which receives bills of various denominations but circulates and reuses bills of only a specific denomination, for example 10,000 yen bills.

First, the general arrangement of the bill receiving and dispensing machine in which the bill delivering apparatus of the present invention is incorporated will be explained referring to FIG. 5.

When a user issues a command requestry bill acceptance, a shutter 3 of a transaction port 2 mounted on a machine body 1 is opened to expose a bill receiving and dispensing mouth 4. In the case that bills (or a bill) are actually inserted into the transaction port 2, the received bills are pressed by a bill pressing mechanism 5 (FIG. 1) with proper pressure and fed out one by one by a received-bill feeding-out mechanism 6 and then transferred t a discriminating section 8 through a discriminating route 7. The discriminated bills are guided into a common route 10 by a first fork 9. Bills discriminated as genuine at the discriminating section 8 are guided by a second fork 11 into an accumulating route 12. On the contrary, bills discriminated as counterfeit are guided into a rejection route 13. The genuine bills passing through the accumulating route 12 are continuously accumulated on a supporting plate 17 forming one part of an accumulating and transferring mechanism 16 via an accumulation wheel 15 for temporarily pooling which forms a part of a bill delivering means 14. The counterfeit bills passing through the rejection route 13 are fed into a rejection port 18.

The bills accumulated on the supporting plate 17 are transferred to a position above the mouth 4 and dropped thereon, and further transferred to the discriminating route 7 again by the received-bill feeding-out mechanism 6. Bills discriminated as 10,000 yen bills at discriminating section 8 are guided into a bill receiving route 19 by the first fork 9 and then fed into a circulating-bill pooling section 22 by a third fork 20 through an accumulating wheel 21 for circulating bills. On the contrary, bills other than 10,000 yen bills are guided into a received-bill containing means 23 by the third fork 20 and then accommodated in a received-bill box 25 via an accumulation wheel 24 for holding received bills.

When a bill dispensation command is made by the user, the 10,000 yen bills are fed out to a bill dispensing route 27 from the circulating-bill pooling means 22 by a circulating-bill feeding-out means 26. Bills other than 10,000 yen bills, for example, 1,000 yen bills or 5,000 yen bills, are supplied beforehand to a dispensation bill containing means 28 and fed out by a dispensation bill feeding-out mechanism 29 to the bill dispensing route 27. During these operations, a check is made for abnormalities, for example, to determine whether the bills for dispensation are being fed in an overlapped condition. When an abnormality is found, the bills are returned to the received bill box 25 of the received-bill containing means 23 by a fourth fork 30, the bill receiving route 19 and the third fork 20. On the contrary, when no abnormality is found, the bills are guided to the common route 10 by the fourth fork 30 and then guided by the second fork 11 to the accumulating route 12. The bills on the accumulating route 12 are then continuously accumulated on the supporting plate 17 by the accumulation wheel 15 for temporary pooling. After having accumulated thereon to a desired amount of money, the bills on the supporting plate 17 are dropped into the bill receiving and dispensing mouth 4 by driving the accumulating and transferring mechanism 6. Finally, by opening the shutter 3, it permits the user to take out the bills from the mouth 4.

More details on the transaction port means 2 and the bill delivering apparatus 14 of the present invention will hereinafter be explained. As shown in FIG. 1, the bill receiving and dispensing mouth 4 of the transaction port means 2 comprises a supporting plate **4*a* descending from the shutter 3 and a vertical plate 4*b* by which the ends of the accumulated bills on the supporting plate 4*a* are flushed. An opening 4*c* for feeding out the bills is formed between these plates 4*a* and 4*b***.

Also, as shown in FIG. 1, the received-bill feeding-out mechanism 6 comprises a roller 31 for ejecting the lowermost bill of the accumulated bills one by one from the opening **4*c*, a roller 32 for taking the ejected bills into the inside of the bill receiving and dispensing machine by the frictional force of the roller 32 contacting with the bills, a roller 33 arranged opposite to the taking-in roller 32 which is either non-rotational relative to the taking-out roller 32 or rotational counter to the feeding-out direction of the bills in order to prevent overlapped feeding of bills, and a member 34 which normally closes the opening 4*c* to flush the ends of lowermost bills and opens the opening 4*c* by pivoting around its supporting shaft 34*a*** for permitting the bills to pass therethrough.

Figure 4:
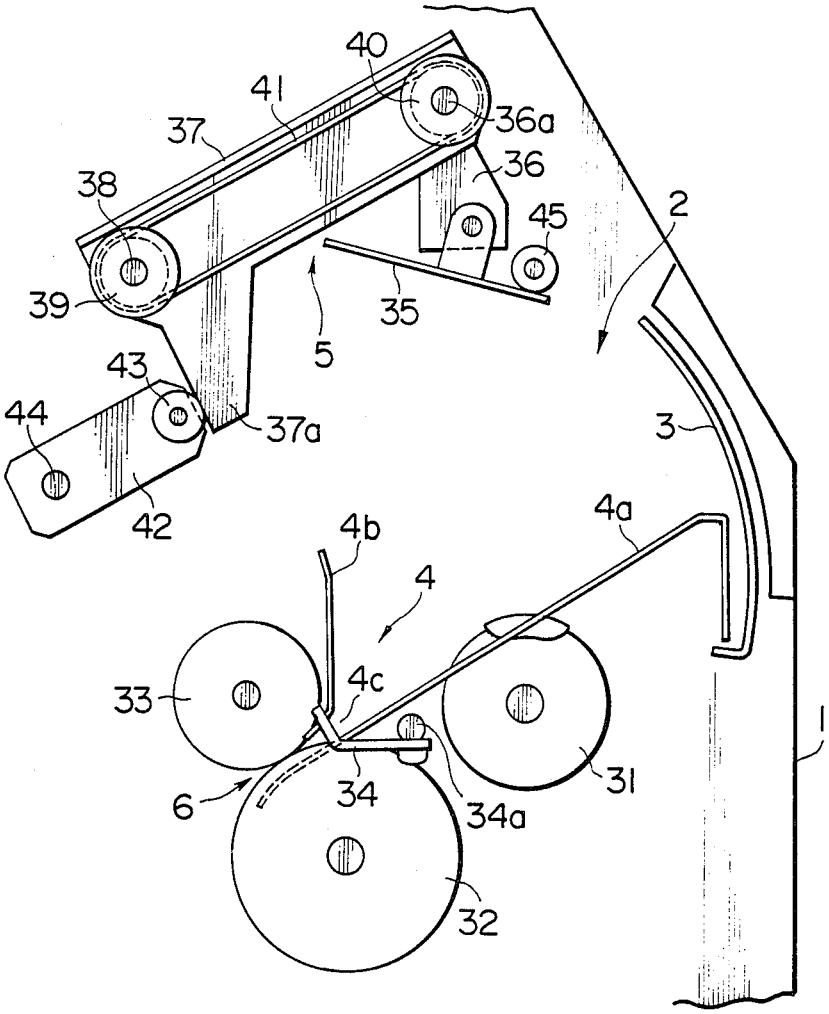
FIG. 4 is a side elevational view of the transaction port means seen from a direction opposite to that in FIG. 1; and, FIG. 5 is a schematic view of the overall construction of the bill receiving and dispensing machine.

As shown in FIGS. 1 and 4, the bill pressing mechanism 5 assisting the bill taking-in operation at the transaction port means 2 comprises a pressing plate 35 pivotably suspended from a supporting member 36, and a shaft **36*a* of the supporting member 36 which in turn is rotatably mounted on one end of a frame 37. The other end of the frame 37 is pivotably mounted on a shaft 38 secured to the machine body 1 and therefore the pressing plate 35 is moved upward and downward by pivoting the frame 37 around the shaft 38. A timing belt 41 is wound around pulleys 39 and 40 which are secured to the shaft 38 and 36*a*, respectively. Thus, the supporting member 36 can be moved upward and downward without changing its posture relative to the machine body 1 when the frame 37 is pivoted around the shaft 38. A projection 37*a* is formed integrally with said other end of the frame 37 and adapted to contact with a roller 43 mounted on one end of an operating member 42. The other end of the operating member 42 is secured to a shaft 44 connected to a driving motor (not shown) and is adapted to vertically rotate therearound. The pressing plate 35 is held in a condition spaced apart above the bill receiving and dispensing mouth 4 of the transaction port means 2 with the roller 43 abutted against the projection 37*a* of the frame 37 when the pressing plate 35 is in the standby position of FIG. 4. On the other hand, the pressing plate 35 is moved to the bill receiving and dispensing mouth 4 to press the bills fed thereon owing to rotation of the frame 37 in the clockwise direction due to gravity by energizing the driving motor and rotating the operating member 42 in the counter-clockwise direction and releasing the support for the frame 37 by the roller 35. The pressing plate 43 is suspended at a position remote from its center of gravity and is adapted to be held in parallel to the inclined supporting plate 4*a* of the mouth 4 when it is in a freely suspended condition. On the other hand, the pressing plate 35 is held in an inclined position as shown in FIG. 4 in order to avoid interference with the transferring operation of the bill delivering apparatus 14 with the positioning member 45 secured to the machine body 1 contacting the upper face of the pressing plate 35**.

As shown in FIG. 1, the bill delivering apparatus 14 is positioned diagonally upward from the transaction port means 2 and comprises the accumulation wheel 15 for temporary pooling which has vanes **15*a* for receiving the bills fed out from the accumulating route 12 one by one therebetween and the accumulating and transferring mechanism 16 which drops the bills into the mouth 4 after having received and accumulated the bills on the supporting plate 17**.

The accumulating and transferring mechanism 16 includes scraping members 46 arranged vertically at both sides of the accumulation wheel 15 to scrape the bills off the vanes **15*a*, and the supporting plate 17 for accumulating the bills scraped off and dropped from the vanes 15*a*. These scraping members 46 and the supporting plate 17** are moved horizontally by a driving mechanism which is constructed in following manner.

Figure 2:
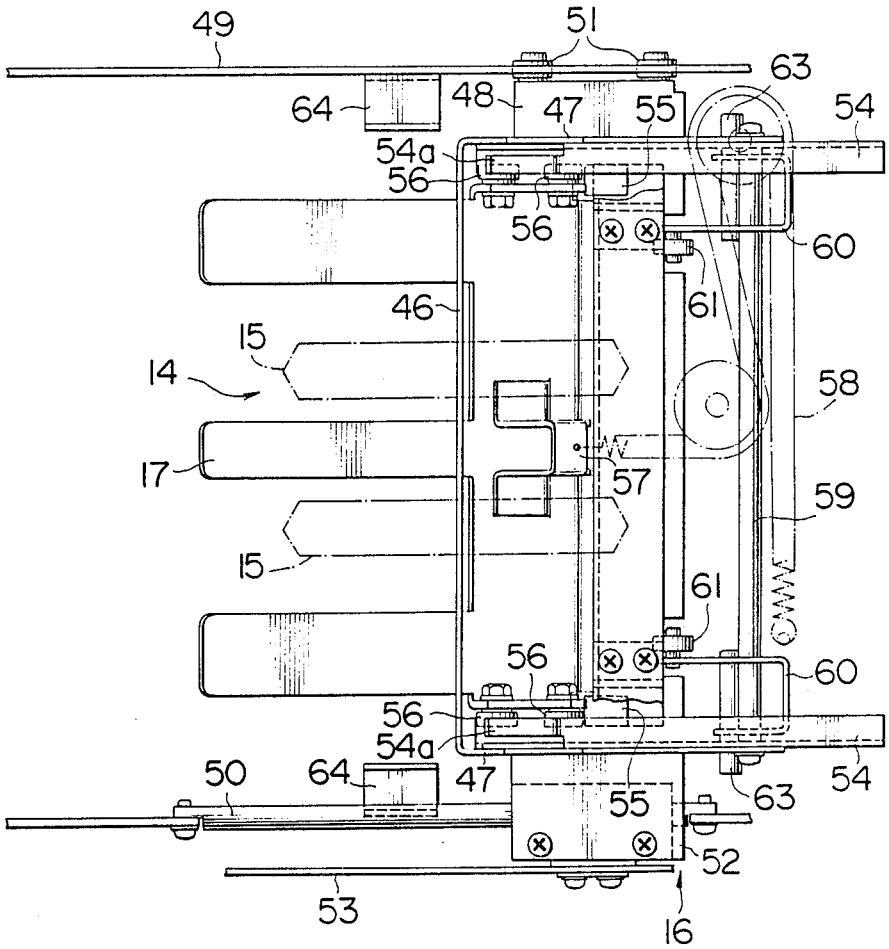
FIG. 2 is a plan view of the bill delivering apparatus.
Figure 3A:
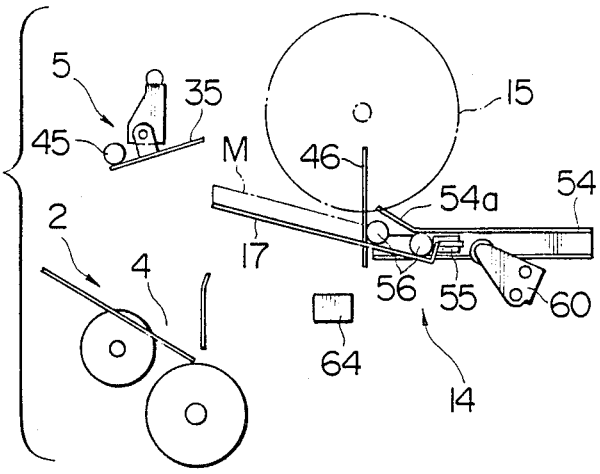
FIG. 3 (*a*)–(*e*) are explanatory drawings showing the steps of operation of the bill delivering apparatus.
Figure 3B:
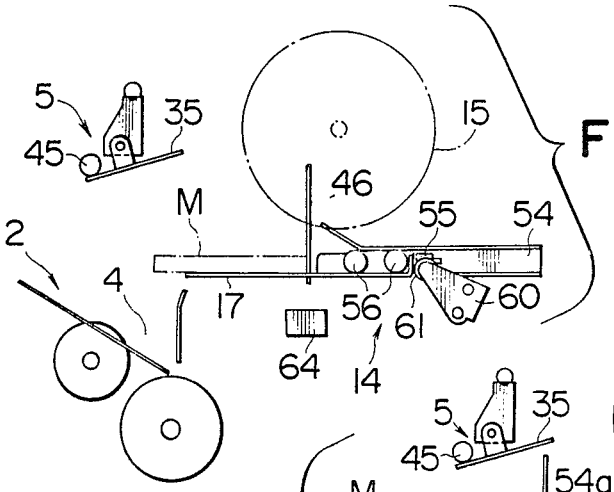
Figure 3C:
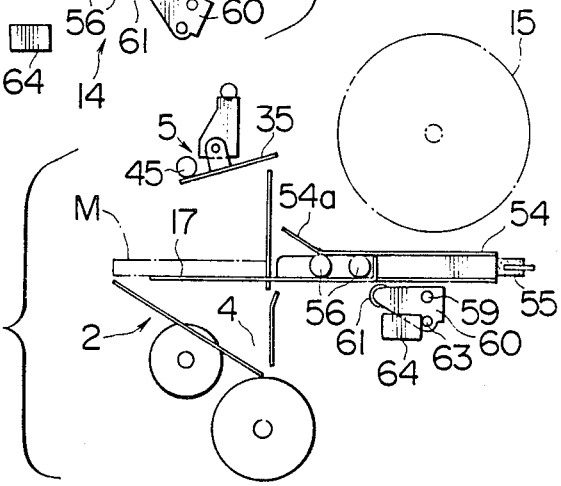
Figure 3D:
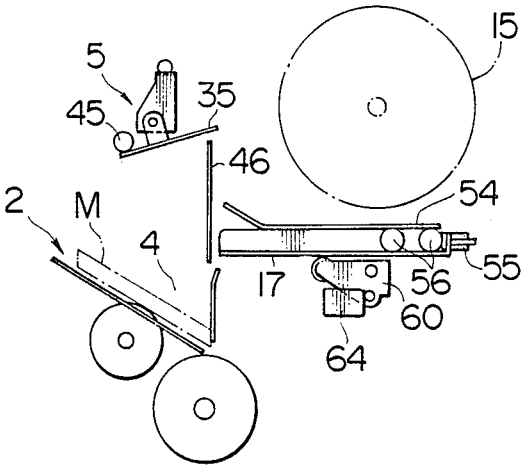
Figure 3E:
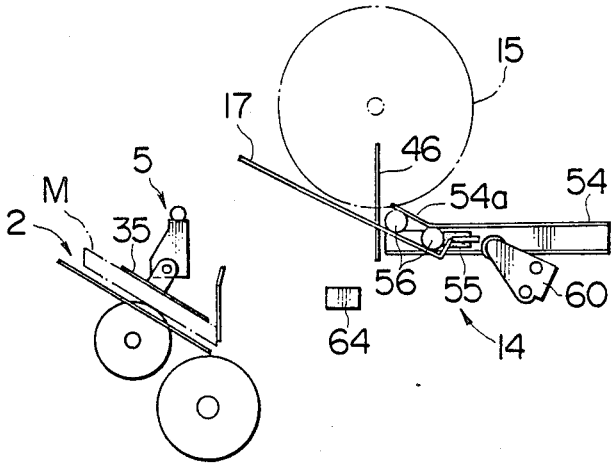

That is, as shown in FIGS. 1 and 2, side plates 47 are mounted on the scraping members 46 at both sides thereof. A horizontal mounting plate 48 supporting the bottom of the side plates 47 extends between a horizontally elongated slot **49*a* formed in a supporting frame 49 for supporting the mounting plate 48 and a horizontal shaft 50 and is slidably supported on the rollers 51. The mounting plate 48 has a driving block 52 secured thereto which in turn is connected to a reversible driving motor (not shown) through a driving belt 53. Thus the mounting plate 48 can be moved horizontally along the elongated slot 49***a* by the driving motor. In addition, the mounting plate 48 has a pair of slide rails 54 secured thereon. Each slide rail 54 has a "C" shaped cross-section and the rails are so arranged that their open-groove face toward each other. The fore end of each slide rail 54 has an upwardly inclined portion 54*a*. A stopper 55 fixed on the machine body 1 projects into the inside of each slide rail 54 for limiting the movement of the supporting plate 17 at its bill accumulating position. As best shown in FIG. 2, the fore end of the supporting plate 17 is divided into a plurality of fingers adapted to pass through notches (not shown) formed in the scraping members 46 and the base end of the supporting plate 17 is provided with guide rollers 56 contacting with the slide rails 54. One end of a spring 58 is secured to the machine body 1 and the other end is attached to a supporting piece 57 which is secured to the base end of the supporting plate 17. Owing to the pulling force of the spring 58 action on the supporting piece 57, the supporting plate 17 is kept in upwardly inclined condition as shown in FIG. 1 with the guide rollers 56 in contact with the upwardly inclined portion 54*a* of the slide rails 54 and the stoppers 55. Each side plate 47 is provided with a pushing-out member 60 pivotable around a shaft 59. Each pushing-out member 60 is in turn provided with a pushing-out roller 61 swingable in a space between the slide rails 54, together with the pivotal motion of the pushing-out member 60, and an engaging shaft 63 engageable with a notch 62 formed in each side plate 47. The pushing-out member 60 is usually urged clockwise in FIG. 1 by a spring (not shown). FIG. 1 shows the engaging shafts 63 in engagement with the notches 62 and the pushing-out rollers 61 projected into the space between the slide rails 54 behind (rightward in FIG. 1) the stoppers 55. Furthermore, an engaging member 64 is fixed on the machine body 1 at a position horizontally away toward the left from the engaging shaft 63 which is now in engagement with the notch 62 as shown in FIG. 1. The engaging member 64 abuts against the engaging shaft 63 and turns the pushing-out member 60 counter-clockwise around its shaft 59 so as to retract the pushing-out roller 61 from the space between the slide rails 54 when the pushing-out member 60 is moved leftward in FIG. 2 together with the scraping members 46 as hereinafter explained. That is, the engaging member 64 is adapted to regulate the terminal position of horizontal movement of the supporting plate 17, i.e. the bill delivering position.

Figure 5:
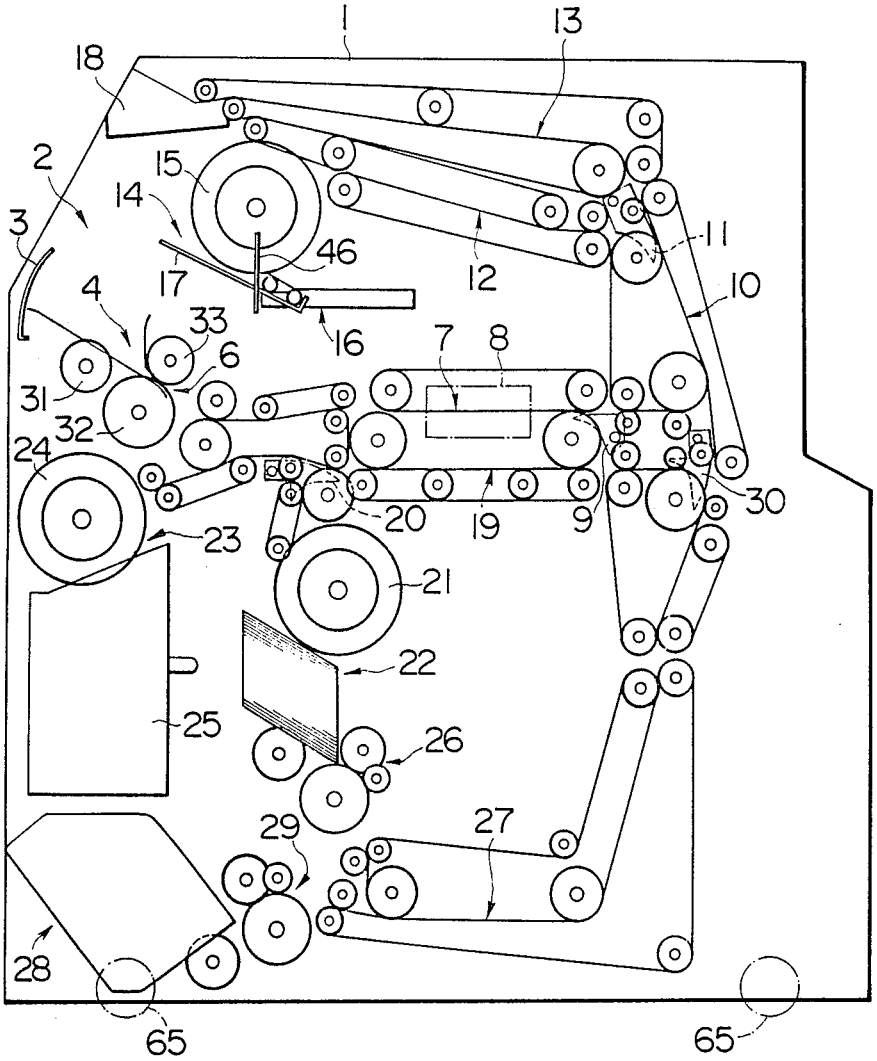

The numeral 65 in FIG. 5 denotes casters for moving the machine 1.

The operation of the bill delivering apparatus 14 of the present invention will be explained referring to FIGS. 3(*a*)–(*e*).

As shown in FIG. 3(*a*), the supporting plate 17 of the bill delivering apparatus 14 rotates counter-clockwise around the guide rollers 56 abutting against the stopper 55 when the bills M received from the accumulation wheel 15 for temporary pooling are stacked on the supporting plate 17 in accordance with the amount of bills. On completion of the accumulating operation, a motor (not shown) is actuated in response to a completion signal and the slide rails 54 are moved leftward along the elongated slots 49*a* (FIG. 1) and the horizontal shaft 50 (FIG. 2). Owing to the movement of the slide rails 54, the supporting plate 17 is positioned horizontally as shown in FIG. 3(*b*) with the supporting plate 17 abutted against the pushing-out rollers 61 of the pushing-out member 60.

Then as shown in FIG. 3(*c*), when the slide rails 54 are moved leftward with the pushing-out rollers 61 pushing the supporting plate 17 until the supporting plate 17 is positioned above the bill receiving and dispensing mouth 4 of the transaction port means 2, the engaging shaft 63 of the pushing-out member 60 abuts against the engaging member 64 and therefore the pushing-out member 60 is rotated counter-clockwise around the supporting shaft 59. Owing to the rotation of the pushing-out member 60, the supporting force for the supporting plate 17 by the pushing-out rollers 61 is lost and therefore the supporting plate 17 is horizontally retracted along the slide rails 54 by the urging force of the spring 58 until the guide rollers 56 abut against the stoppers 55 as shown in FIG. 3(*d*). Thus the bills M stacked on the supporting plate 17 drop into the mouth 4. During conditions of FIG. 3(*a*)–(*d*), the pressing plate 35 of the bill pressing mechanism 5 is kept horizontal by the positioning member 45 to avoid interference with the movement of the scraping member 46.

Then, by reversing the driving motor to drive the slide rails 50 toward the rightward original position, the supporting plate 17 is returned to its original inclined position as shown in FIG. 3(*e*). The condition of FIG. 3(*e*) is that when the machine is in the received-bill handling operation and therefore the upper surface of the stack of bills M is in pressed condition by the pressing plate 35 of the bill pressing mechanism 5 which is operated after the bills M are fed to the transaction port means 2.

As can be understood from the explanations above, the bill delivering apparatus of the bill receiving and dispensing machine of the present invention has the following effects.

(i) It is able to reliably and easily deliver the bills M keeping them in accumulated condition only by dropping them into the bill receiving and dispensing mouth 4 without need of the complicated clamping mechanism of the prior art for pressing the top and bottom surfaces of the accumulated bills M, since the accumulated bills M are automatically dropped into the bill delivering position by the scraping member 46 with the supporting plate 17 bearing the accumulated bills thereon horizontally retracted.

(ii) It is possible to continuously carry out both the transferring and delivering operations of the accumulated bills M by a single power source, since the supporting plate 17 is automatically retracted by the engaging member 64 and the bills M accumulated on the supporting plate are delivered to the transaction port means 2 when the accumulated bills M are horizontally moved by the movement of the slide rails 54.

(iii) It is possible to stabilize the accumulated condition of the bills, since the supporting plate 17 is held in inclined condition by the upwardly inclined portion 54*a* of the slide rails 54 just under the accumulating wheel 15 and can immediately receive thereon the bills from the accumulating wheel 15 so that the ends of the bills positively abut against the scraping member 46.

What we claim is:

1. A bill delivering apparatus for delivering accumulated bills to a horizontally spaced-apart position within a bill receiving and dispensing machine, said apparatus comprising: a scraping member for scraping off the bills fed one by one to an accumulation wheel and for accumulating bills on a supporting plate at an accumulation position, said scraping member being able to be horizontally moved to contact the ends of the bills accumulated on said supporting plate by a driving mechanism, said supporting plate supports the bills scraped off by said scraping member and accumulated thereon, said supporting plate being horizontally movable together with said scraping member, slide rail means for guiding said supporting plate and said slide rail means being horizontally secured to a back of said scraping member and being horizontally movable therewith, an end of said supporting plate being engaged with said slide rail means so as to be movable longitudinally along said slide rail means and so as to be movable together with said scraping member and said slide rail means during delivery of the bills at a delivering position, a spring for urging said supporting plate in a direction reverse to the movement of said slide rail means during the delivery of bills, a pushing-out member swingably mounted on said scraping member in a vertical plane and horizontally movable with said scraping member and said slide rail means so as to support the end of said supporting plate, a stopper secured to the bill receiving and dispensing machine for restricting the movement of said supporting plate in an urging direction of said spring by abutting against said supporting plate at the accumulating position of bills, and an engaging member secured to the bill receiving and dispensing machine for rotating said pushing-out member by abutting against it at the delivering position of bills to release the support of said pushing-out member with said supporting plate so that said supporting member can be moved along said slide rail means and relative to said scraping member by being urged by said spring.

2. A bill delivering apparatus according to claim 1 wherein ends of said slide rail means are provided with upwardly inclined portions relative to the horizontal movement direction of said slide rail means during a bill delivering operation, said supporting plate being held in an inclined condition while said supporting plate does not support any bills thereon with said supporting plate urged by said spring in contact with said upwardly inclined portions.

* * * * *